US007571764B1

(12) United States Patent
Sammann

(10) Patent No.: US 7,571,764 B1
(45) Date of Patent: Aug. 11, 2009

(54) WELL COVER PLATE ARRANGEMENT AND METHOD OF USE

(76) Inventor: Jess Sammann, 1107 Yonkers, Plainview, TX (US) 79072-4859

( * ) Notice: Subject to any disclaimer, the term of this patent is extended or adjusted under 35 U.S.C. 154(b) by 5 days.

(21) Appl. No.: 12/104,884

(22) Filed: Apr. 17, 2008

(51) Int. Cl.
*E21B 19/00* (2006.01)

(52) U.S. Cl. ..... 166/75.13; 166/94.1

(58) Field of Classification Search ..... 166/92.1, 166/93.1, 94.1, 75.13, 379
See application file for complete search history.

(56) References Cited

U.S. PATENT DOCUMENTS

| | | | | |
|---|---|---|---|---|
| 2,735,697 A | | 2/1956 | Zanin | 285/22 |
| 3,463,247 A | * | 8/1969 | Klein | 173/164 |
| 3,527,295 A | * | 9/1970 | Gangel et al. | 166/85.1 |
| 3,631,895 A | | 1/1972 | Medina et al. | 138/69 |
| 3,963,054 A | | 6/1976 | Martin | 138/89 |
| 4,111,388 A | * | 9/1978 | Presley | 248/49 |
| 4,129,151 A | | 12/1978 | Henson | 138/89 |
| 4,202,376 A | | 5/1980 | Forsell | 138/89 |
| 4,972,905 A | | 11/1990 | Henson | 166/92 |

* cited by examiner

*Primary Examiner*—Jennifer H Gay
*Assistant Examiner*—Daniel P Stephenson
(74) *Attorney, Agent, or Firm*—Charles D. Gunter, Jr.

(57) ABSTRACT

A well cover arrangement is shown for covering the exposed opening of a well where the well has a submersible pump supported on a collared well string which is suspended downwardly in the well. The cover arrangement includes both a U-plate with a U-shaped opening therein and a door element which fits within the U-plate opening. Once the door element is properly positioned on the U-plate, cooperating locking elements maintain its proper position. The ultimate weight of the well tubing string further secures the door element as the collar in the well string contacts a portion of the door element, making removal of the door element only possible by first lifting the well string.

14 Claims, 3 Drawing Sheets

WELL COVER PLATE ARRANGEMENT AND METHOD OF USE

BACKGROUND OF THE INVENTION

1. Field of the Invention

The present invention relates generally to a cover plate arrangement for a well such as a water well and, more specifically, to a cover plate arrangement for a well which is quickly and easily centered above an exposed well bore and which is held securely in place by an associated well pump once in position on the well.

2. Description of the Prior Art

Modern water wells are drilled into the ground with the well bore either being uncased, or being protected by a casing which is sunk into the well. Typically, a submersible pump is then run down the well bore on either rigid or flexible tubing and submerged in water located at the bottom of the well. The pump provides water to the surface through the flexible tubing which is connected to the pump and which leads up the well bore to the well surface. Although various types of flexible tubing are known, the most commonly used tubing today is a polyolefin, such as polyethylene. In certain of the prior art practices, a separate safety rope or cable is also provided, connected to the pump and extending the length of the bore to assist in withdrawal of the submersible pump from the well bore if the pipe were to separate or break. In addition, since the submersible pump is electrically driven, a power cord or cable also typically extends from the well surface down the bore to the pump where it is attached to the flexible tubing, as by taping the cable to the tubing.

The present invention has general applicability to "cased" wells of the type described above where cylindrical tubing in the form of steel pipe is inserted into the well shaft which has been formed to serve as the side walls of the well. Typically a short portion of this casing is either flush with, or extends slightly above the ground as the upper terminal of the well, which must be covered to prevent foreign matter from entering the well. Although a cased well of the type previously described is commonly encountered in the field, it will be understood upon further reading of the present specification that the invention being described also has applicability to uncased wells which must also be covered with some type of well cover plate arrangement, or to well heads which have a concrete pad or the like poured at the well surface to form the well opening.

In any event, whatever the particular configuration of the well head or well opening, a well cover plate arrangement of some type is generally needed to provide security for the well to prevent the entry of foreign matter, and also to provide provision for passing the flexible tubing, electrical cable, and other accessory lines to the down hole pump which is submerged in the well. Since the well cover plate provides provisions for passing tubing to the pump, which is submerged in the well, the cover must be easily removed so that the pump can be replaced or repaired when necessary, and the cover must be generally centered on the casing in order to center the pump in the well.

While simple devices such as a plate with the required openings conceivably could be permanently welded or otherwise affixed to the top end of a well casing, the fact that the submersible pumps fail and sometimes must be replaced dictates that some form of removable seal or cap be provided. As a result, a variety of different types and styles of removable well cover plates have been provided in the industry, such as those shown in Zanin, U.S. Pat. No. 2,735,697, Medina, U.S. Pat. No. 3,631,895, Martin, U.S. Pat. No. 3,963,054, Henson, U.S. Pat. No. 4,129,151, Forsell, U.S. Pat. No. 4,202,376, and Henson, U.S. Pat. No. 4,972,905. However, the devices shown in the prior art, such as those included above, have all generally involved complicated and sophisticated clamping and centering means, which are prohibitively expensive for use in many instances, such as in a single family water well. In addition the complexity of these devices greatly adds to the difficulty in installing and removing the cover, and results in a high rate of failure when the cover is repeatedly removed and installed.

Some well casings use successive threaded sections of pipe, while others have successive sections welded together. While it is theoretically possible in threaded casing installations to provide a removable well cap which threadedly engages threads provided at the upper end of the well casing, caps which thread onto the well casing are deemed impractical for a number of reasons. Turning a threaded cap to install it would undesirably twist the electrical cable which must pass through it, unless the cable passed through an opening in the cap so large that insects or rainwater could also pass through the opening. Also, prohibitively great forces often would be required to unscrew a threaded cap which had been exposed to weather for some years. For such reasons, practical removable well caps cannot be threaded onto the upper ends of well casings.

It is also advantageous that well cover plate arrangements not employ a plurality of bolts or nuts in securing the cover plate to the well head since the bolts and nuts frequently must be installed under adverse weather conditions. If bolts or nuts are accidentally dropped they are frequently lost in mud, snow or the like at a well side. Where some sort of bolt and nut arrangement is spaced about the well cover, their threads sometimes become jammed or may be inadvertently stripped, sometimes ruining the whole assembly unless it is re-bored and re-tapped with a larger threaded hole, or sometimes requiring that spare bolts or nuts be obtained. A further disadvantage of seals using plural bolts and nuts spaced around the cover plate is that they must be tightened evenly, i.e. by tightening a given bolt only partially and then proceeding to similarly tighten each of the other bolts before further tightening the given bolt. This is a time consuming and somewhat tedious procedure at best.

It is the object of the present invention to provide an improved well cover plate arrangement which overcomes the various mentioned disadvantages of the prior art by providing a combination U-plate and door element of unique design which are economical to manufacture and which can be easily installed under field conditions.

It is a further object of the present invention to provide an improved combination U-plate and door element, each of which is of a "single-piece" nature, the plates being formed from readily available materials utilizing simple manufacturing techniques.

It is a further object of the invention to provide an improved well cover plate arrangement which does not require sequential tightening of a plurality of bolts and/or nuts in order to install the assembly.

The provision of such a well cover plate arrangement allows a well cover assembly to be installed or removed much more rapidly than prior assemblies, generally requiring only a single worker, thereby providing a significant savings in labor costs.

SUMMARY OF THE INVENTION

The well cover arrangement of the invention provides an improved device and method for covering the exposed opening of a well where the well has a submersible pump supported on a well tubing string suspended downwardly in the well where the well string has at least one support collar formed thereon. The improved combination device of the invention includes a U-plate having an upper planar surface, a lower planar surface and a thickness there between. The upper and lower planar surfaces are circumscribed by an outer peripheral edge. The U-plate has a U-shaped opening formed at one point in the outer peripheral edge. The combination device of the invention also includes a door element having an upper planar surface and a lower planar surface, the door element being sized to approximately cover the U-shaped opening formed in the peripheral edge of the U-plate when the U-plate is in place on a well string. The assembled U-plate and door element form the combination base plate of the invention.

Engageable locking elements are present on the U-plate and on the door element which, when engaged, allow the door element to slide into position on the U-plate by movement in a general horizontal plane parallel with a plane defined by the upper planar surface of the U-plate. The locking elements also serve to prevent movement of the door element in a vertical direction off the U-plate once the locking elements are engaged.

Preferably, the door element has a leading edge and a trailing edge, and wherein the leading edge forms a semicircular opening which is sized to form an opening of the approximate diameter of the well tubing string so that a collar present in the well string will rest upon the upper planar surface of the door element and lock the plate in position as weight of the well string bears against the U-plate and door element. The locking elements can comprise, for example, spaced notches and slots formed adjacent the U-shaped opening on the U-plate which are engageable with mating spaced notches or slots formed on the door element. The preferred door element also has a pair of spaced side rails running on either of two sides thereof between the leading edge and the trailing edge, the side rails having tapered leading surfaces which assist in locating the well string within the U-shaped opening of the door element.

The preferred U-plate can be equipped with a raised strip formed on the upper planar surface thereof which spans two opposing peripheral edges thereof adjacent the U-shaped opening, the raised strip serving to brace and reinforce the U-plate in use. The door element which is used as a part of the well cover arrangement of the invention will also typically be provided with a fitting which communicates the upper and lower planar surfaces thereof, the fitting being adapted to receive an electrical conduit for providing electrical power to the submersible pump being suspended in the well. The U-plate is also typically provided with a carrying handle affixed to the upper planar surface thereof.

While the cover plate arrangement of the invention can be used with a variety of submersible pump installation devices, it finds particular utility when used in an installation piocedure for installing and removing a submersible pump from a well bore where the pump is supported on a length of a flexible tubing string which is initially wound up on a take up reel, the tubing string having at least one collar located in an upper extent thereof. One preferred apparatus of this type includes a pivot frame which is mounted on a portable base frame which is transportable from one well location to another. The portable base frame is supported in a horizontal plane with respect to a surrounding support surface, and wherein the pivot frame is capable of pivoting movement in a plane generally parallel to the plane of the base frame. A pair of oppositely arranged support arms are mounted on the pivot frame, each of the support arms being pivotally mounted at an inner extent at a pivot point on the pivot frame and having an opposite outer extent.

A cylindrical take up reel is also provided having opposing sides separated by a central region for accumulating the flexible tubing string, each of the opposing sides of the cylindrical take up reel being supported on the portable base frame by connection to a selected one of the respective support arms. A primary pivot mechanism has a first extent pivotally attached to the pivot frame and has a second extent pivotally attached to a respective one of the support arms whereby actuation of the primary pivot mechanism serves to pivot the support arm and, in turn, the cylindrical take up reel between a collapsed position on the base frame and an extended, upright position.

The previously described installation apparatus is used by first transporting the base frame to a well site adjacent a well bore having a vertical well axis. Next, the primary pivot mechanism is actuated to raise the support arms and, in turn, the take up reel from a collapsed position to a work position which is vertically oriented with respect to a vertical axis of the well bore with the submersible pump being centered up as much as possible with respect to the well bore vertical axis. The take up reel is then actuated in order to dispense a required length of flexible tubing string so that the submersible pump is gradually lowered into the well bore. The well tubing string has a support collar which is connected to an upper end of the flexible tubing string, the collar having a greater external diameter than the flexible tubing string at the connection.

The previously described U-plate and door element which make up the well cover assembly of the invention is then provided at the well site. A worker slides the U-shaped opening of the U-plate about the tubing string below the collar. The door element is then moved into position on top of the U-plate with the U-shaped opening formed in the U-plate approximately covering the U-shaped opening in the U-plate and contacting the well tubing string so that the tubing string passes through the remainder of the opening formed between the door element and U-plate. The door element can then be secured in position on top of the U-plate by setting down weight on the tubing string and, in turn, upon the door element and U-plate.

To remove the submersible pump from the well, weight is first lifted off the door element and U-plate by pulling upwardly on the tubing string. The door element can then be slid off the U-plate and the above described procedure basically repeated in reverse fashion.

These and other aspects of the invention will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
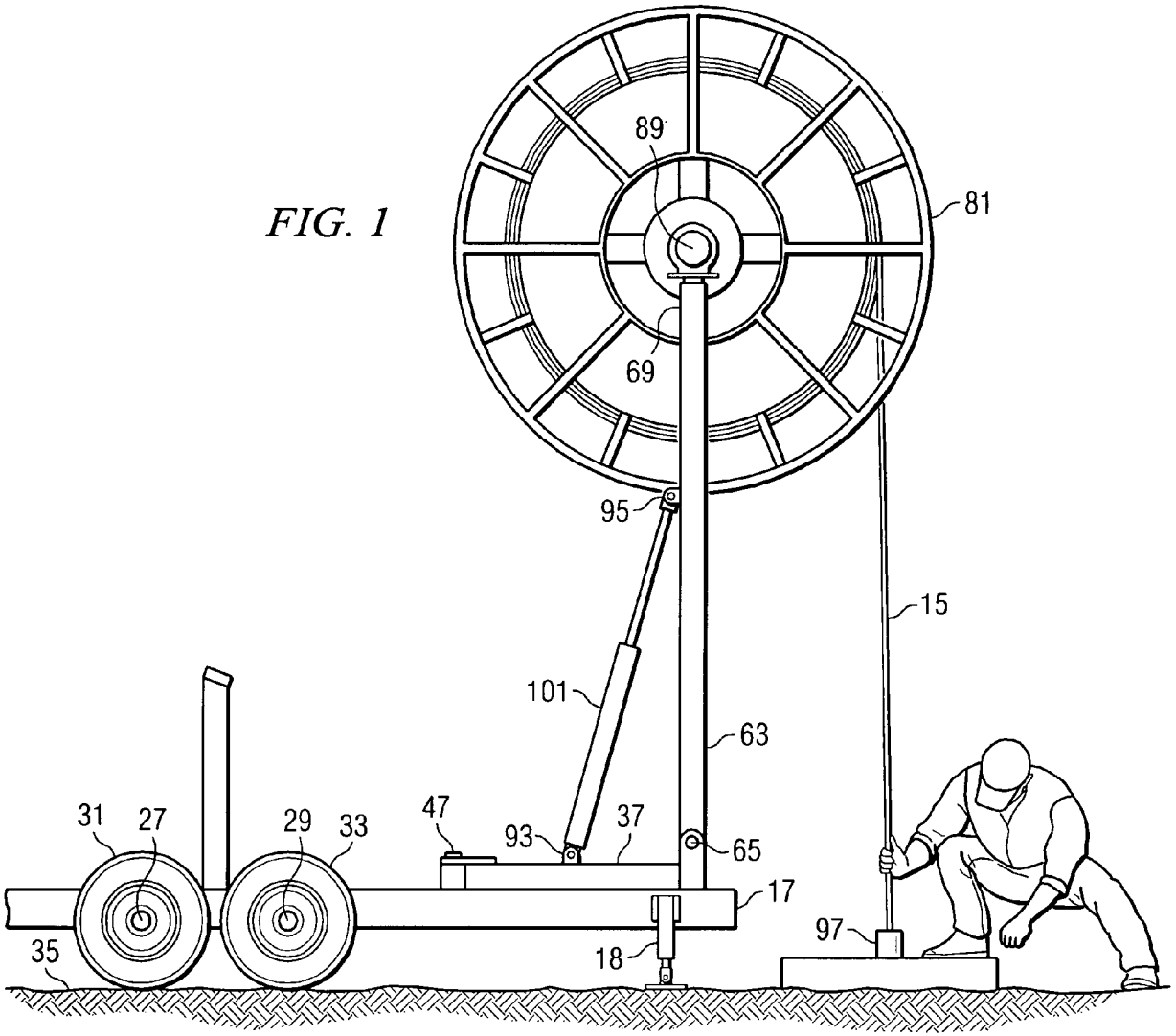
FIG. 1 is a perspective view of a well servicing operation in which a submersible well pump is about to be pulled from the well bore on a cable, the well being covered with the cover plate arrangement of the invention.

In order to understand the particular utility of the combination U-plate and door element which make up the well cover arrangement of the invention, the general environment surrounding the installation of a submersible well pump will first be described. Turning to FIG. 1 of the drawings, there is shown an apparatus 11 for raising and lowering a submersible pump 13 in a well bore where the pump is run on a length of a flexible well tubing string 15. In the example illustrated in FIG. 1, the flexible tubing string 15 is polyethylene tubing. As will be appreciated from FIG. 1, the particular well installation apparatus 11 includes a portable base 17 of a generally polygonal configuration, in this case a rectangular frame. The frame is made up of front and rear elongate members and elongate side members. The frame 17 can be made of any convenient sturdy material, e.g., channel iron or the like. As will be appreciated from FIG. 1, the frame 17 is supported on a pair of axles 27, 29 and associated wheels 31, 33, so that the frame can be transported from one well location to another.

FIG. 1 shows the frame 17 as it would be equipped to be towed from the trailer hitch of a pickup. The frame could also be transferred in other ways as, for example, by being skid mounted, or truck or trailer mounted. As also will be appreciated from FIG. 1, the wheels 31, 33 and axles 27, 29 support the frame 17 in a horizontal plane with respect to a surrounding support surface 35, which in this case is a section of roadway. Hydraulic struts or stabilizers 18 are provided to support the frame in the position shown in FIG. 1 once the base frame has been temporarily positioned.

Referring again to FIG. 1, it can be seen that a pair of oppositely arranged support arms (63 shown) are each pivotally mounted at an inner extent 65 on a pivot frame 37. Each of the support arms also has an opposite outer extent 69. A cylindrical take up reel (81 in FIG. 1) is supported on the support aims 63 and has opposing sides and a central region 87 for accumulating the continuous roll of flexible tubing 15. Each of the opposing sides of the cylindrical take up reel is supported on the portable base frame 17 by connection a respective one of the support arms 63. The pivot frame 37 allows pivoting movement in the horizontal plan while the pivot arm 63 allow pivoting movement about the pivot point 65.

As can be seen in FIG. 1, an outer extent of the support arm 63 mounts to a commercially available gear reduction unit 89. While a variety of commercially available gear reduction units might be utilized, the particular unit illustrated utilizes a planetary gear system in which a hydraulic motor (not shown) drives the center gear of the unit on either side of the take up reel. A ring gear is turned by a set of planetary gears to provide a desired gear reduction. The ring gear is, in turn, attached to the main hub upon which the cylindrical drum is mounted. There is an identical arrangement on the opposite side of the cylindrical drum and hub.

It will be appreciated with respect to FIG. 1 of the drawings that the support arms 63 are each pivoted between a retracted or collapsed position and the extended or vertical work position shown in FIG. 1 by a primary pivot mechanism. In the example illustrated, the primary pivot mechanism is comprised of at least one hydraulic cylinder 101 which is attached to the pivot frame and to the support arms at pivot points 93, 95, respectively, whereby actuation of the primary pivot mechanism serves to pivot the support arms and, in turn, the cylindrical take up reel between the collapsed position resting on the base frame, and the extended, upright position. The hydraulic cylinder 101 is of conventional design and is commercially available from a number of convenient sources. It is hydraulically powered by a hydraulic motor (not shown in FIG. 1) as will be well understood by those skilled in the relevant arts. The pivot mechanism allows the position of the cylindrical drum to be accurately centered with respect to a vertical axis of a well bore to be accessed for raising and lowering the submersible pump into the well bore.

FIG. 1 shows a string of flexible well tubing 15 being used to either raise or lower a submersible pump from a well bore. The tubing string includes at least one support collar (generally at 97 in FIGS. 1 and 2) formed therein.

Figure 2:
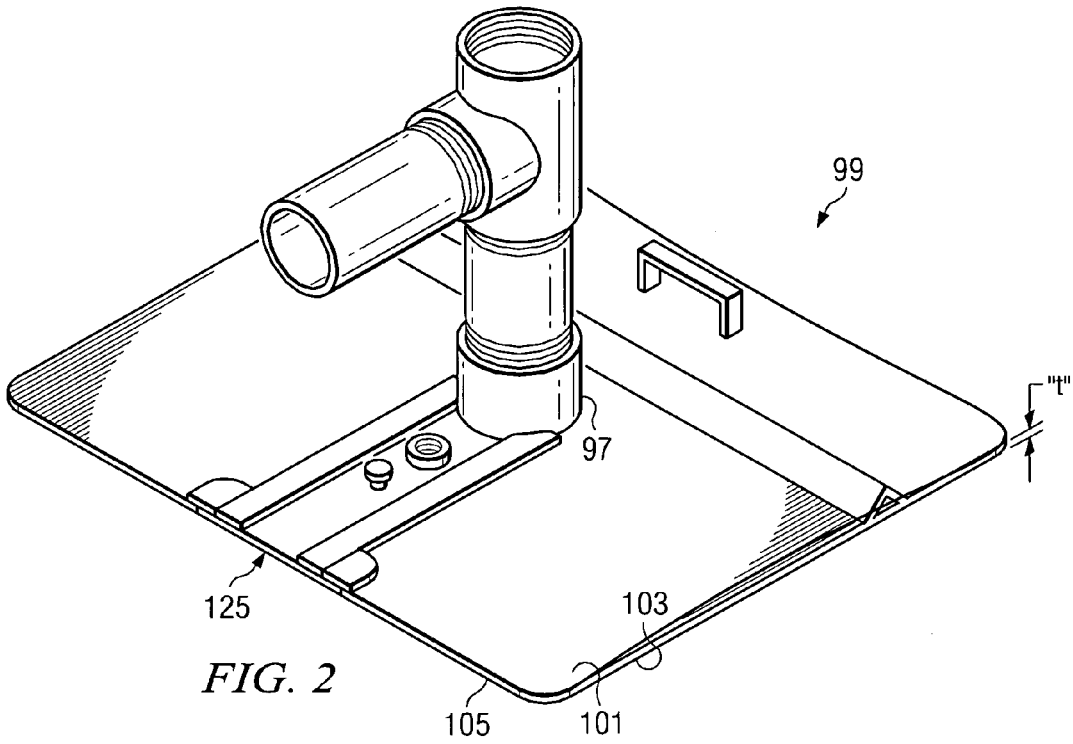
FIG. 2 is an isolated view of the U-plate and door element which make up the cover plate arrangement of the invention, showing the exposed submersible pump collar resting upon the cover plate arrangement.
Figure 3A:
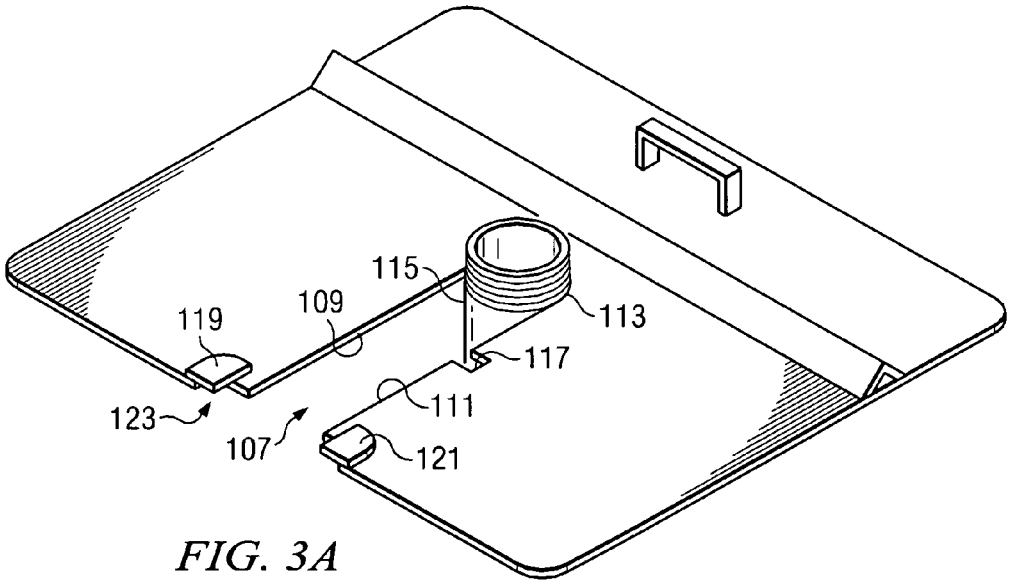
FIG. 3A is a view of the improved U-plate of the invention showing the first step in installing the well cover arrangement of the invention with the U-plate being positioned about an upper portion of the well tubing string, the tubing string collar being removed for ease of illustration.
Figure 3B:
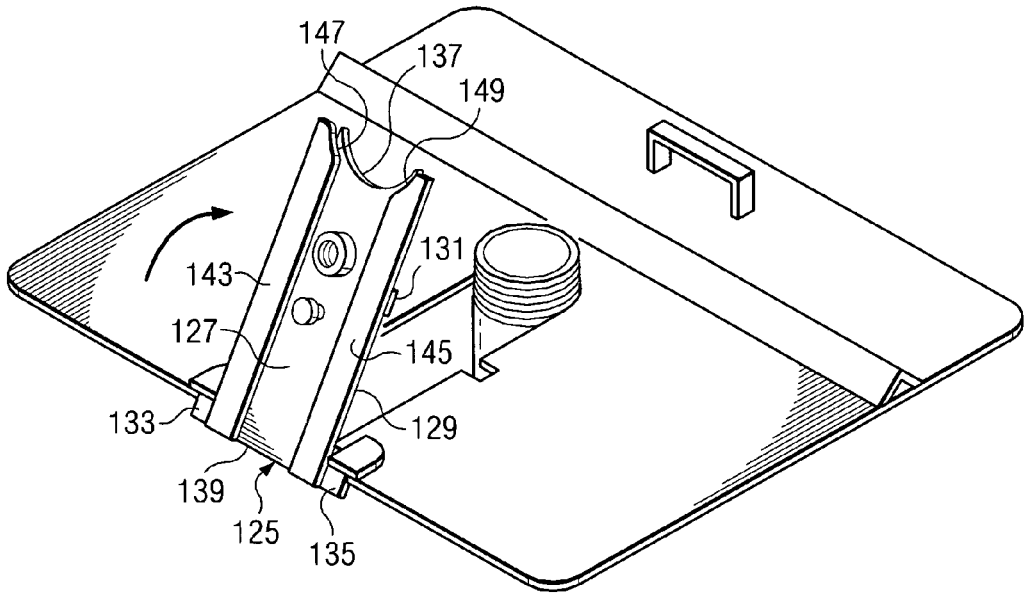
FIG. 3B shows the next step in the assembly of the cover plate arrangement of the invention in which the improved door element is installed on the U-plate.
Figure 3C:
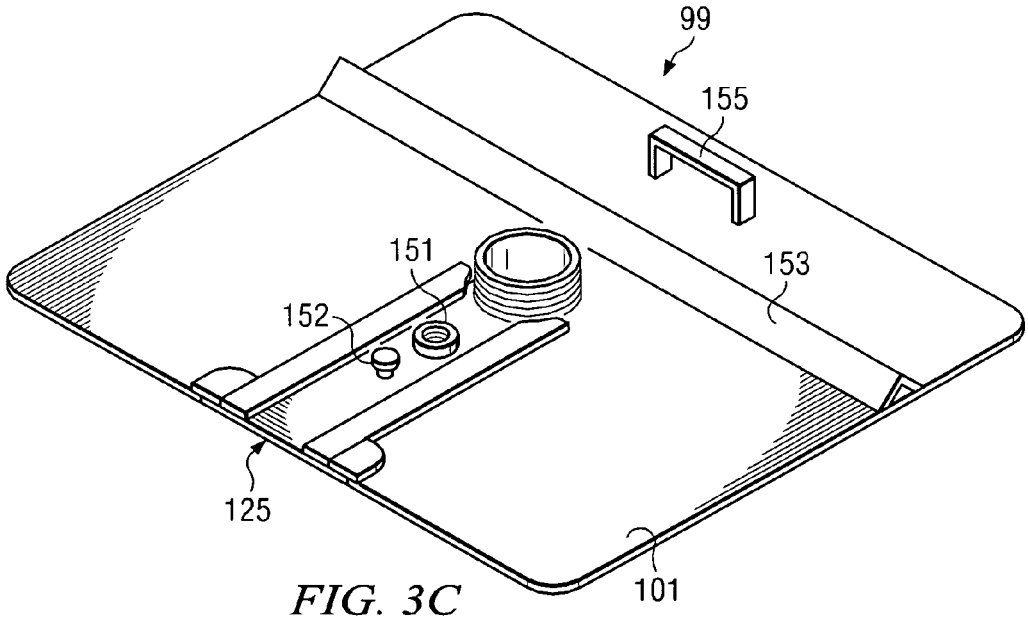
FIG. 3C is a view similar to FIG. 3B, but showing the next step in the installation of the well cover of the invention with the door element being installed in its final position.

With reference now to FIGS. 2-3C, there is shown the improved well cover plate assembly of the invention. The cover plate assembly includes a U-plate (99 in FIG. 2) having an upper planar surface 101, a lower planar surface 103 and a thickness "t" there between. The upper and lower planar surfaces 101, 103 are circumscribed by an outer peripheral edge 105. As can perhaps be best seen from FIG. 3A, the U-plate 99 has a U-shaped opening 107 formed at one point in the outer peripheral edge 105. The U-shaped opening 107 is an elongate recess in the U-plate formed by parallel sidewalls 109, 111, and terminating in an arcuate end region 113. The width of the opening 107 is selectively sized to closely receive the outside diameter of the well tubing string (115 in FIG. 3A). It will also be appreciated from FIG. 3A that the U-shaped opening has at least one notch 117 formed in the sidewall 111. The top surface 101 of the U-plate also has a pair of tabs 119, 121 affixed thereto which form slots 123 for receiving and matingly engaging a cooperating U-shaped U-plate.

As can be seen in FIG. 3B, the door element 125 has an upper planar surface 127 and a lower planar surface 129. The door element 125 is sized to approximately cover the U-shaped opening 107 formed in the peripheral edge of the U-plate 99 when the door element is in place on a well string. The door element 125 also has a side tab 131 which is adapted to be received in the notch 117 of the U-shaped opening 107, and has end tabs 133, 135 which engage the slots 123 formed on the U-plate adjacent the U-shaped opening. The side tab 131 and end tabs 133, 135, together with the notch 117 and slots 123 on the U-plate, form engageable locking elements present on the U-plate and on the door element which, when engaged, allow the door element to slide into position on the U-plate by movement in a general horizontal plane parallel with a plane defined by the upper planar surface of the U-plate. When in position shown in FIG. 3C, the tabs 133, 135 prevent the door element 125 from being raised up at the back. FIGS. 3B and 3C generally illustrate this action. The locking elements also serve to prevent movement of the door element in a vertical direction off the U-plate once the locking elements are engaged.

As can be seen in FIG. 3B, the door element 125 has a leading edge 137 and a trailing edge 139. The leading edge 137 preferably forms a semi-circular opening which is sized to form an opening of the approximate diameter of the well string so that a collar (such as collar 97 in FIG. 2) which is present in the well string will rest upon the upper planar surface 127 of the door element and lock the plate in position as weight of the well string bears against the U-plate and door element. Preferably, the door element has a pair of spaced side rails 143, 145 running on either of two sides thereof between the leading edge 137 and the trailing edge 139 thereof which support the door element above the U-shaped opening 107. The side rails have tapered leading surfaces 147, 149 (see FIG. 3B), which assist in locating the well string within the U-shaped opening of the U-plate.

As can be seen in FIG. 3C, the door element 125 will typically be provided with a fitting 151 which communicates the upper and lower planar surfaces thereof, the fitting being adapted to receive an electrical conduit for providing electrical power to the submersible pump being suspended in the well. A nut 152 is provided to receive and secure an electrical ground wire. As will be apparent from FIG. 3C, when the door element 125 is removed, the associated electrical wiring travels with the door element. It will also be appreciated from FIG. 3C that the U-plate 99 in the version of the invention shown has a raised strip 153 formed from angle iron or channel iron on the upper planar surface 101 thereof which spans two opposing peripheral edges thereof adjacent the U-shaped opening. The raised strip 153 serves to brace and add strength to the U-plate. This allows the U-plate to be formed of lighter weight material, for example ½ inch thick steel plated. The U-plate 99 will also typically be provided with a carrying handle 155 for convenience.

The general operation of the apparatus of the invention will now be briefly described. The apparatus of the invention can be used in an improved method for lowering and pulling a submersible pump from a well bore where the pump is supported on a length of flexible tubing initially wound up on a take up reel. While the operation of the invention will be described with respect to a length of flexible tubing, it will be understood that it could be used with a string of rigid tubing, as well. The previously described portable base frame 17 is moved into position at the well site, as shown in FIG. 1. The primary pivot mechanism 101 is then actuated to raise the support arms 63 and, in turn, the take up reel 81 from a collapsed position to a work position which is vertically oriented with respect to the vertical axis of the well bore with the submersible pump being centered up as much as possible with respect to the well bore vertical axis. Pivot frame 37 helps to provide a fine adjustment for the centering action.

The take up reel 81 is then actuated to dispense a required length of flexible tubing so that the submersible pump is gradually lowered into the well bore. When the desired depth is reached, the upper end of the flexible tubing is secured at the well head using the improved well cover assembly of the invention. This is conveniently accomplished by connecting a support collar (97 in FIG. 2) to an upper end of the flexible tubing string, the collar having a greater external diameter than the flexible tubing string at the connection. The U-plate 99 is then slid into the position shown in FIG. 3A with the well tubing string engaged within the U-shaped opening 107. The support collar 97 is shown removed in FIG. 3A for ease of illustration. However, it will be understood that the U-plate 99 will be slid beneath the support collar 97 to the position shown in FIG. 2.

The door element 125 is then slid into position, as shown in FIGS. 3B-3C to approximately cover the U-shaped opening 107 in the U-plate 99 and to come into contact with the tubing string so that the tubing string passes through the remainder of the opening formed between the door element and U-plate. The door element is then secured in position by setting down weight on the tubing string and, in turn, upon the door element and U-plate. This position is shown at FIG. 2 of the drawings. It will be appreciated that the engageable locking elements present on the U-plate and on the door element, when engaged, allow the door element to slide into the position shown in FIG. 3C on the U-plate by movement in a general horizontal plane parallel with a plane defined by the upper planar surface 101 of the U-plate. The locking elements also serving to prevent movement of the door element in a vertical direction off the U-plate once the locking elements are engaged. The semi-circular opening (137 in FIG. 3B) at the leading edge of the door element 125 which is sized to form an opening of the approximate diameter of the well tubing string so that a collar present in the well tubing string will rest upon the upper planar surface of the door element and lock the plate in position as weight of the well string bears against the U-plate and door element.

An invention has been provided with several advantages. The combination U-plate and door element of the invention work together to provide a secure well cover assembly. Once the door element is moved into position and weight is set down upon the support collar of the tubing string, the cover plate assembly is securely locked into position and can only be removed by first removing weight from the well string. The assembly of the invention is economical to manufacture and can be easily installed under field conditions. The assembly of the well cover plate of the invention does not require sequential tightening of a plurality of bolts and/or nuts in order to install the assembly. The present well cover plate arrangement allows a well cover assembly to be installed or removed much more rapidly than prior assemblies, generally requiring only a single worker, thereby providing a significant savings in labor costs.

While the invention has been shown in only one of its forms, it is not thus limited but is susceptible to various changes and modifications without departing from the spirit thereof.

What is claimed is:

1. A well cover arrangement for covering the exposed opening of a well where the well has a submersible pump supported on a well string suspended downwardly in the well, the well string having at least one support collar formed therein, the well cover arrangement comprising, in combination:

a U-plate having an upper planar surface, a lower planar surface and a thickness there between, the upper and lower planar surfaces being circumscribed by an outer peripheral edge, the U-plate having a U-shaped opening formed at one point in the outer peripheral edge;

a door element having an upper planar surface and a lower planar surface, the door element being sized to approximately cover the U-shaped opening formed in the peripheral edge of the U-plate when the U-plate is in place on a well string;

engageable locking elements present on the U-plate and on the door element which, when engaged, allow the door element to slide into position on the U-plate by movement in a general horizontal plane parallel with a plane defined by the upper planar surface of the U-plate, the locking elements also serving to prevent movement of the door element in a vertical direction off the U-plate once the locking elements are engaged;

wherein the door element has a leading edge and a trailing edge, and wherein the leading edge forms an opening which is sized to be of the approximate diameter of the well string so that a collar present in the well string will rest upon the upper planar surface of the door element and lock the plate in position as weight of the well string bears against the U-plate and door element.

2. The well cover arrangement of claim 1, wherein the door element has a pair of spaced side rails running on either of two sides thereof between the leading edge and the trailing edge, the side rails having tapered leading surfaces which assist in locating the well string within the U-shaped opening of the door element.

3. The well cover arrangement of claim 2, wherein the locking elements include a pair of spaced slots formed adjacent the U-shaped opening on the U-plate which are engageable with mating spaced tabs formed on the door element as well as a notch formed along one sidewall of the U-plate which is engageable with a third tab formed on one side of the door element.

4. The well cover arrangement of claim 3, wherein the door element is provided with a fitting which communicates the upper and lower planar surfaces thereof, the fitting being adapted to receive an electrical conduit for providing electrical power to the submersible pump being suspended in the well.

5. The well cover arrangement of claim 4, wherein the U-plate has a raised strip formed on the upper planar surface thereof which spans two opposing peripheral edges thereof adjacent the U-shaped opening, the raised strip serving to brace and reinforce the U-plate.

6. The well cover arrangement of claim 5, wherein the U-plate has a carrying handle affixed to the upper planar surface thereof.

7. A method of installing and removing a submersible pump from a well bore where the pump is supported on a length of a flexible tubing string which is initially wound up on a take up reel, the tubing string having at least one collar located in an upper extent thereof, the method comprising the steps of:

mounting a pivot frame on a portable base frame which is transportable from one well location to another, the portable base frame being supported in a horizontal plane with respect to a surrounding support surface, and wherein the pivot frame is capable of pivoting movement in a plane generally parallel to the plane of the base frame;

mounting a pair of oppositely arranged support arms on the pivot frame, each of the support arms being pivotally mounted at an inner extent at a pivot point on the pivot frame and having an opposite outer extent;

providing a cylindrical take up reel having opposing sides separated by a central region for accumulating the flexible tubing string, each of the opposing sides of the cylindrical take up reel being supported on the portable base frame by connection to a selected one of the respective support arms;

providing a primary pivot mechanism having a first extent pivotally attached to the pivot frame and having a second extent pivotally attached to a respective one of the support arms whereby actuation of the primary pivot mechanism serves to pivot the support arm and, in turn, the cylindrical take up reel between a collapsed position on the base frame and an extended, upright position;

transporting the base frame to a well site adjacent a well bore having a vertical well axis;

actuating the primary pivot mechanism to raise the support arms and, in turn, the take up reel from a collapsed position to a work position which is vertically oriented with respect to a vertical axis of the well bore with the submersible pump being centered up as much as possible with respect to the well bore vertical axis;

actuating the take up reel to dispense a required length of flexible tubing string so that the submersible pump is gradually lowered into the well bore;

connecting a support collar to an upper end of the flexible tubing string, the collar having a greater external diameter than the flexible tubing string at the connection;

providing a U-plate having an upper planar surface, a lower planar surface and a thickness there between, the upper and lower planar surfaces being circumscribed by an outer peripheral edge, the U-plate having a U-shaped opening formed at one point in the outer peripheral edge;

sliding the U-shaped opening about the tubing string below the collar;

providing a door element having an upper planar surface and a lower planar surface, the door element being sized to approximately cover the U-shaped opening formed in the peripheral edge of the U-plate when the U-plate is in place on the tubing string;

positioning the door element to approximately cover the U-shaped opening in the U-plate and to come into contact with the tubing string so that the tubing string passes through the remainder of the opening formed between the door element and U-plate;

securing the door element in position by setting down weight on the tubing string and, in turn, upon the door element and U-plate.

8. The method of claim 7, wherein the U-plate and door element are provided with engageable locking elements present on the U-plate and on the door element which, when engaged, allow the door element to slide into position on the U-plate by movement in a general horizontal plane parallel with a plane defined by the upper planar surface of the U-plate, the locking elements also serving to prevent movement of the door element in a vertical direction off the U-plate once the locking elements are engaged.

9. The method of claim 8, wherein the door element has a leading edge and a trailing edge, and wherein the leading edge forms a semi-circular opening which is sized to form an opening of the approximate diameter of the well tubing string so that a collar present in the well tubing string will rest upon the upper planar surface of the door element and lock the plate in position as weight of the well string bears against the U-plate and door element.

10. The method of claim 9, wherein the door element has a pair of spaced side rails running on either of two sides thereof between the leading edge and the trailing edge, the side rails having tapered leading surfaces which assist in locating the well tubing string within the U-shaped opening of the door element.

11. The method of claim 9, wherein the locking elements include a pair of spaced slots formed adjacent the U-shaped opening on the U-plate which are engageable with mating spaced tabs formed on the door element as well as a notch formed along one sidewall of the U-plate which is engageable with a third tab formed on one side of the door element.

12. The method of claim 11, wherein the door element is provided with a fitting which communicates the upper and lower planar surfaces thereof, the fitting being adapted to receive an electrical conduit for providing electrical power to the submersible pump being suspended in the well.

13. The method of claim 12, wherein the U-plate has a raised strip formed on the upper planar surface thereof which spans two opposing peripheral edges thereof adjacent the U-shaped opening, the raised strip serving to brace and reinforce the U-plated in use.

14. The method of claim 13, wherein the U-plate has a carrying handle affixed to the upper planar surface thereof.

* * * * *